US005720042A

United States Patent [19]

Wilkinson

[11] Patent Number: 5,720,042

[45] Date of Patent: Feb. 24, 1998

[54] ENERGY EXPENDITURE GARMENT

[76] Inventor: William T. Wilkinson, P.O. Box 73, Salem, N.J. 08079

[21] Appl. No.: 761,290

[22] Filed: Dec. 6, 1996

Related U.S. Application Data

[60] Provisional application No. 60/026,969, Sep. 20, 1996.

[51] Int. Cl.[6] ..... A41D 1/06; A63B 21/02

[52] U.S. Cl. ..... 2/69; 482/105; 482/125

[58] Field of Search ..... 2/69, 79, 227, 2/228, 238, 159, 160, 70; 482/105, 121, 122, 124, 125

[56] References Cited

U.S. PATENT DOCUMENTS

| | | | |
|---|---|---|---|
| 1,178,165 | 8/1916 | Lupton . | |
| 2,097,376 | 10/1937 | Marshman . | |
| 2,613,932 | 10/1952 | Manners . | |
| 3,411,500 | 11/1968 | Gatts . | |
| 3,559,654 | 2/1971 | Pope . | |
| 3,759,510 | 9/1973 | Jackson . | |
| 4,065,814 | 1/1978 | Fox . | |
| 4,220,299 | 9/1980 | Motter . | |
| 4,325,379 | 4/1982 | Ozbey . | |
| 4,384,369 | 5/1983 | Prince . | |
| 4,670,913 | 6/1987 | Morell . | |
| 4,698,847 | 10/1987 | Yoshihara . | |
| 4,910,802 | 3/1990 | Malloy | 2/69 |
| 4,953,856 | 9/1990 | Fox . | |
| 4,961,573 | 10/1990 | Wehrell . | |
| 4,968,028 | 11/1990 | Wehrell . | |
| 4,993,705 | 2/1991 | Tölle | 482/105 |
| 5,033,123 | 7/1991 | Audet . | |
| 5,046,194 | 9/1991 | Alaniz et al. | 2/69 |
| 5,060,315 | 10/1991 | Ewing . | |
| 5,062,642 | 11/1991 | Berry et al. | 482/105 |
| 5,109,546 | 5/1992 | Dicker | 2/70 |
| 5,141,223 | 8/1992 | Block . | |
| 5,176,600 | 1/1993 | Wilkinson . | |
| 5,186,701 | 2/1993 | Wilkinson | 482/125 |
| 5,201,074 | 4/1993 | Dicker | 2/70 |
| 5,203,754 | 4/1993 | Maclean . | |
| 5,256,119 | 10/1993 | Tudor . | |
| 5,263,916 | 11/1993 | Bobich . | |
| 5,267,928 | 12/1993 | Barile et al. | 482/124 |
| 5,282,277 | 2/1994 | Onozawa . | |
| 5,306,222 | 4/1994 | Wilkinson . | |
| 5,308,305 | 5/1994 | Romney | 482/124 |
| 5,336,139 | 8/1994 | Miller . | |
| 5,357,637 | 10/1994 | Moore | 2/227 |
| 5,367,708 | 11/1994 | Fujimoto | 2/69 |
| 5,372,565 | 12/1994 | Burdenko . | |
| 5,375,610 | 12/1994 | Lacourse . | |
| 5,383,235 | 1/1995 | Peters . | |
| 5,465,428 | 11/1995 | Earl . | |
| 5,518,480 | 5/1996 | Frappier . | |
| 5,518,481 | 5/1996 | Darkwah . | |
| 5,570,472 | 11/1996 | Dicker . | |

*Primary Examiner*—Gloria Hale
*Attorney, Agent, or Firm*—Connolly & Hutz

[57] ABSTRACT

An energy expenditure garment includes a body portion and a pair of limb portions, such as arms or legs. At least one section of the garment is made of closed loop circumferential form to completely surround a portion of the user and is made of elastic resilient material thereby applying a compressive force to that portion of the user. The garment also includes a plurality of elongated elements made of elastic resilient material located on the garment and anchored across areas of the garment which would be subjected to back and forth movement during the performance of an activity by the user.

27 Claims, 2 Drawing Sheets

ENERGY EXPENDITURE GARMENT

This application is based upon provisional application Ser. No. 60/026,969, filed Sep. 20, 1996.

BACKGROUND OF THE INVENTION

Various garments have been suggested which include elastic elements to provide a resistance to an activity which would require the swinging or bending of the arms or legs or the bending of various body portions. Examples of such garments are found in U.S. Pat. Nos. 5,109,546; 5,176,600; 5,186,701; 5,201,074; 5,306,222 and 5,570,472.

Compression garments have previously been used for dealing with various athletic problems such as chronically strained or pulled muscles. Such compression garments have included compression shorts or fitness shorts made with LYCRA®. Consideration has also been given to using compressive garments for improving the level of performance of an athlete, for better muscular alignment and for less muscular fatigue.

SUMMARY OF THE INVENTION

An object of this invention is to combine and improve upon the prior approaches of utilizing a garment for energy expenditure by longitudinal resistance elements and by compressive structure.

A further object of this invention is to provide such garments wherein the combination of longitudinal resistance elements and compressive loops are formed in the shirt portion and/or pants portion of a garment.

A still further object of this invention is to provide such a garment wherein the longitudinal resistance elements are anchored to compressive cuffs on the sleeves and/or leg portions or other parts of the garment.

A yet further object of this invention is to provide such resistance elements on a garment which is made of entirely compressive material.

THE DRAWINGS

DETAILED DESCRIPTION

Figure 1:
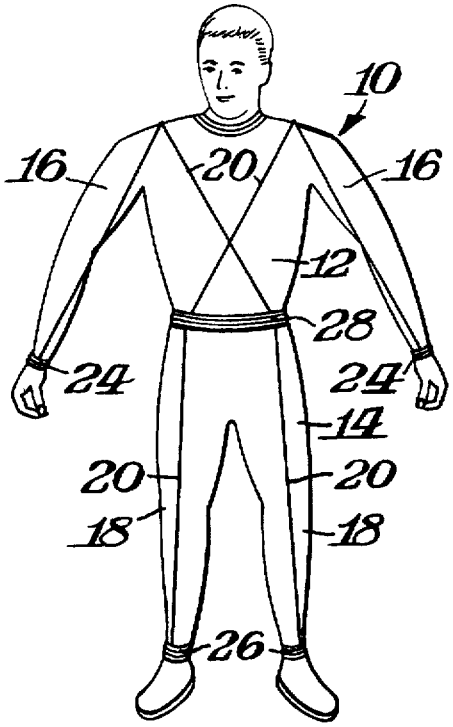
FIG. 1 is a front elevational view showing an energy expenditure garment in accordance with one embodiment of this invention.

The above noted provisional application and U.S. Pat. Nos. 5,109,546; 5,176,600; 5,186,701; 5,201,074; 5,306,222 and 5,570,472, all of the details of which are incorporated herein by reference thereto disclose various techniques for providing elongated resistance elements on garments. The present invention combines those techniques and other variations as will be hereinafter described with compressive structure to provide an energy expenditure garment having enhanced performance.

Attempts have been made to reduce energy expenditure and fatigue through the use of compressive structure garments. Generally, the compressive technique is intended to reduce muscle oscillation and therefore results in less fatigue. Where the present invention utilizes elongated resistance lines of force such as resistive elements in the form of elastic bands, strips or cords, however, the opposite effect is desired, namely to increase muscle oscillation. A basic difference between compression and elastic resistance is in the direction of the force. This may be generally thought of as the elastic resistance being longitudinal along the body parts or transverse across the body parts thus providing a tensile force, whereas the compressive resistance is perpendicular to the elastic resistance and namely compressed inwardly around the body part. In general, the compression techniques have had application in actual participation of competitive sports where, for example, over a period of time fatigue might be reduced by 12%. This reduction results from the reduction of muscle oscillation and also the maintaining of proper form and better balance (i.e. better alignment). In contrast the resistance approach would have, as a primary application, the training for a sport and not necessarily the competitive sport itself. It is to be understood, however, that the resistance approach (alone or in combination with compressive force) may be used in a competitive sport where it is desired to cause limitation/restriction of range of motion so as to prevent an injury or the aggravation of an injury.

In accordance with this invention, beth the compression and resistive techniques are combined. This could be done in various manners. For example, the compressive technique could be achieved by having any suitable number of endless bands or rings located around different portions of the body. Alternatively, all or some of the garment itself may be made of a compressive material, such as LYCRA®. In either case, there would be a complete or generally complete circumscribing of at least a portion of the body which would impose an elastic force inwardly in a compressive manner. The invention would be practiced by using elastic bands, strips or cords or other elongated resistive elements either interconnecting the compressive bands or disposed over or beneath the compressive bends so that there is a combination of both compressive and elongated resistive actions simultaneously taking place.

The present invention which combines resistive elements and compression may be advantageously used for injury prevention or rehabilitation while training. For example, the invention could be used during rehabilitation of an injury during training to avoid aggravating the injury. The compressive characteristics would reduce fatigue and give better muscular alignment. The elongated resistive elements would give strengthening while requiring less time to train.

As later described compressive cuffs may be used as a means of anchoring the resistive bends in the preferred practice of this combination of techniques. The use of cuffs to anchor the resistive elements is particularly advantageous because it takes the pressure off the anchoring body part (i.e. hand, foot, knee, etc.) and produces additional resistance when the limb is extended. The cuffs also more desirably distribute the load.

The compressive bands could entirely or only partially cover or circumscribe the hands or legs and/or torso or could be at spaced portions thereof.

In accordance with this invention the elongated resistance could be longitudinal (up/down) and/or transverse (across portions of the body) and/or by compression (in/out). Thus the resistance could be unidirectional or multidirectional.

Where the entire garment is elastic, there could thereby be multidirectional resistance and to assure a sufficiently tight fit to create compression. Where the entire garment is elastic or compressive, compressive cuffs are optional.

The invention would place the body in physical alignment.

It is not enough that the garment have resistance elements, there must also be proper sizing of the garment to assure the creation of tension from the resistance and to assure a sufficiently tight fit to create compression.

The longitudinal and/or transverse elongated resistive elements such as the elongated elastic bands, strips or cords may be permanently or detachably attached to a cuff or to a glove or sock/shoe and/or permanently or detachably mounted to the garment itself.

The garment could be used for a free standing workout (i.e. not part of any other workout/exercise/sport, but by oneself) or in conjunction with a specific exercise and/or piece of equipment so as to enhance the value of the exercise. Thus, the garment could be used to provide more exercise in the same time period (i.e. enhance an activity) or the same value of exercise in a less time period.

In accordance with one aspect of the invention the degree of resistance would progressively change. For example, a set of garments could be provided each of which differs in its resistance level or degree from the other garments. Thus in an exercise program a garment would be worn of, for example, lesser resistance until the user is ready to encounter greater resistance whereupon a different garment would be worn. Conversely it may be desirable to go to lesser resistance. A further possibility of varying the resistance is to utilize a single garment having the capability of varying the resistive elements or resistive cords. This could be done in various manners, such as by having sections of the same garment of differing degrees of resistance. An example of this is where the top and bottom portions of the garment have differing degrees of resistance. Additionally, various techniques could be used for adjusting the specific amount of resistance/tension. Thus, a certain level of resistance might be utilized which is also capable of having a more specific amount of resistance varied within a range. Another level could then be utilized with its range of adjustable resistance.

The invention could be practiced by using resistance type of connectors (such as elastic members) joining the suit (e.g. sleeves or pant legs) to gloves, shoes, etc. where the suit itself is elastic or non-elastic. The connectors could be permanently or detachably secured and could be adjustable or non-adjustable.

FIG. 1 illustrates one embodiment of the invention wherein a garment 10 is provided in the form of a shirt portion 12 and a pants portion 14. Shirt portion 12 includes sleeves 16 while pants portion 14 includes legs 18. In the embodiment illustrated in FIG. 1, the entire garment itself is made of a compressive type material to maximize the surface area of the user being subjected to the compressive force. Any suitable material may be used for making the shirt portion 12 and pants portion 14. A suitable material is, for example, LYCRA®. Such material is elastic and resilient and thus applies a compressive force to the user. The garment would be sized so that there is surface contact with the user throughout the garment. In other words, the garment would be skin tight so as to apply at least some degree of compression.

FIG. 1 also illustrates the inclusion of a plurality of elongated resistance elements 20 secured to garment 10. In the illustrated embodiment a set of cords 20 extends from the ankle area to the waist, while a further set 20 extends from the waist to the shoulders with the elements crisscrossing. A still further set extends from each wrist to the shoulders. Other locations can also be provided, such as by extending the various elements to the neck portion rather than the shoulders. Preferably identical sets of elements would be provided on the back side of the garment. It is to be understood, however, that other locations for the elongated elements may also be provided. The elements would be made of elastic resilient material and would be located across portions of the garment where some form of movement would take place during the performance of an activity such as in the performance of an exercise or even in simple activities such as walking where there might be a bending of the arms at, for example, the elbows or in an activity where there might be a bending at the waist.

During bending movement, a resistance force would be applied which must be overcome by the user in order to accomplish the bending movement. Thus, the combination of such longitudinal resistance elements and the circumferential compressive elements cooperate to enhance the energy expenditure capability of the garment.

In order to provide the resistive force the elongated resistive elements should be anchored at locations on each side of the bending action. In the illustrated embodiment of FIG. 1 the leg elements are anchored to ankle cuffs 26 and to a waistband or cuff 28. The body elements are anchored to a waist band 28 and to the shoulder or could be anchored to a band around the neck. Separate waistbands would be used for the shirt and pants where the shirt and pants are separate elements. Where a one-piece suit is used the same waistband could provide the anchoring location or the elongated elements might extend completely from the ankle to the shoulder or neck area. The arm elements are anchored to wrist cuffs 24 and to the shoulder or neck. In accordance with one aspect of this invention the wrist cuffs, ankle cuffs and waistbands are also made of elastic resilient material to apply a compressive force around that particular portion of the body. Preferably these cuffs are made of a material which fits more tightly around the body than the remainder of the garment.

The use of compressive cuffs as anchor members is a distinct departure from the suggestions in, for example, U.S. Pat. Nos. 5,186,701 and 5,306,222 which discloses the possibility of using ankle bands or wristbands to anchor the members but then teaches away from such practice by pointing out that the use of such bands would have a greater tendency for some sliding movement up or down the legs or arms. The present invention avoids this disadvantage by forming such ankle bands or wrist bands, as well as the waistbands, of a material which is elastic and resilient and would fit sufficiently tightly around its portion of the body to minimize the tendency for such sliding movement.

Figure 3:
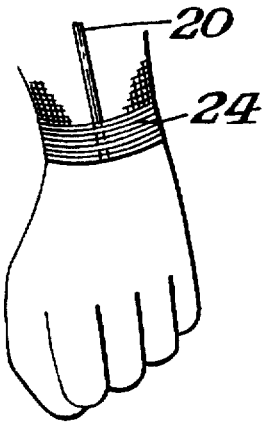
FIG. 3 is a front elevational view showing the anchoring of a resistance element to the wrist in accordance with this invention.
Figure 4:
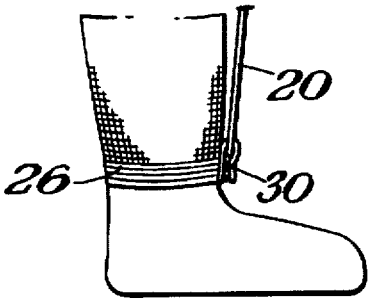
FIGS. 3A, 4 and 4A are side elevational views showing various manners of anchoring the resistance elements in accordance with this invention.
Figure 5:
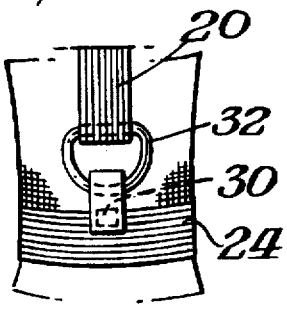
FIG. 5 is a front elevational view showing yet another manner of anchoring the resistance elements in accordance with this invention.

FIGS. 3, 4 and 5 illustrate various manners of anchoring the elongated elements 20 to the various cuffs or bands. As shown in FIG. 3, for example, the end of the element 20 is sewn to or permanently secured to cuff 24. FIG. 4, however, shows a detachable adjustment securement by means of a VELCRO loop element 30 which secures the end of elongated element 20 to ankle cuff 26. FIG. 5 illustrates the element 20 to be secured to a loop 32 which in turn is secured to cuff 24 by, for example, a VELCRO connecting member 30. It is to be understood that these various manners of attachment may be used interchangeably for any of the cuffs.

Figure 4A:
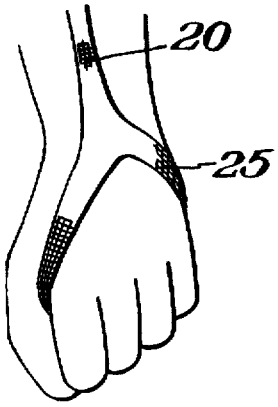
Figure 3A:
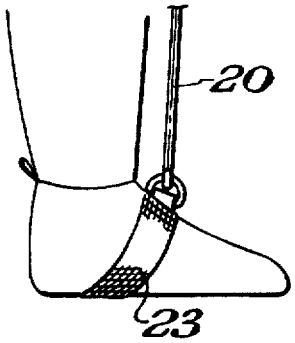

FIGS. 3A and 4A exemplify anchoring options which do not include compressive cuffs. In FIG. 3A the band 20 is secured to a foot stirrup 23, while in FIG. 4A the band 24 is secured to a hand loop 25. FIG. 4A shows the band 24 and hand loop 25 to be integral and made of open mesh material.

Figure 2:
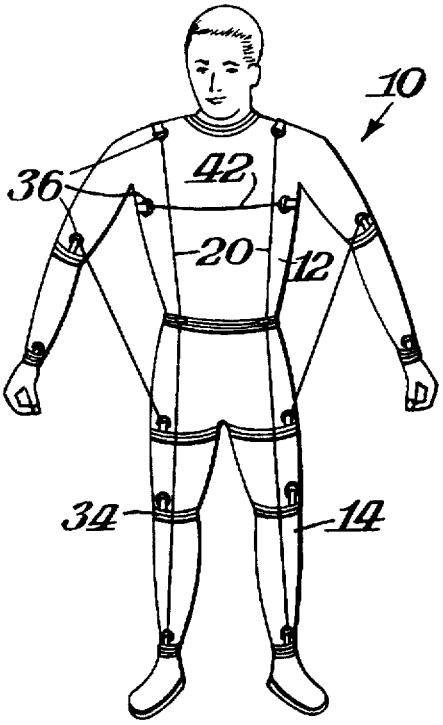
FIG. 2 is a view similar to FIG. 1 of an alternative embodiment of this invention.

FIG. 2 illustrates a variation of the invention wherein instead of or in addition to the shirt 12 and pants 14 being made of compressive material, a plurality of compressive bands 34 is provided at spaced locations on the garment 10. These compressive bands 34 would apply a compressive force in the same manner as in FIG. 1, except as to be more localized. Thus, in either version there is a section of the garment which is of closed loop circumferential form to completely surround a portion of the user and thereby provide the compressive force.

As shown in FIG. 2 other variations in the location of the elongated cords are possible including anchoring the cords to the various bands or passing the cords under or over the bands 34. The anchoring is accomplished by the provision of loops 36 at the desired locations.

FIG. 2 also illustrates a transverse elongated resistive member 42 in addition to the longitudinal members 20.

Although the use of compression cuffs is the preferred manner of anchoring the elongated elements, the invention may also be practiced where the anchoring is achieved along the lines of the aforenoted patents, such as by anchoring the elongated elements to shoes or gloves or forming the elements as stirrups or connecting the elements to the stirrups.

Where the compression characteristics are achieved by having the entire or major parts of the garment made of compressive material, the elongated resistive elements could be incorporated in the garment without any specific added anchoring structure. For example, the elongated resistive elements could be sewn to or otherwise secured to the garment itself and resist movement by the user. Thus, the anchoring is provided by the garment itself being the structure to restrain the elongated resistive elements.

Figure 6:
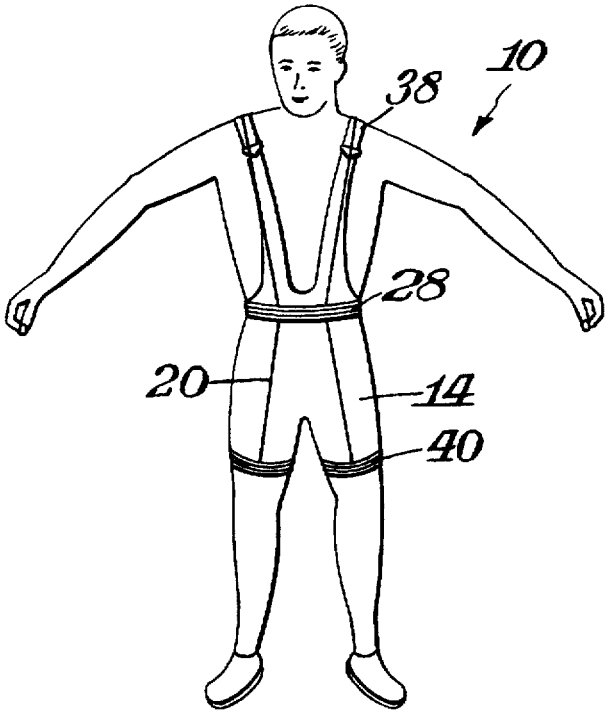
FIG. 6 is a view similar to FIGS. 1 and 2 of a modified form of this invention.

FIG. 6 illustrates a variation of the invention wherein a one-piece garment 10 is provided similar to the type of garment used by a wrestler wherein there is a pants portion 14 which terminates above the knees. The garment 10 would have a waistband 28 and suspender-type members 38. Suspenders 38 may be resistive elements or may include resistive elements. FIG. 6 shows the use of compression cuffs 40 located above the knees. It is to be understood that the invention in its various embodiments may be practiced where compressive cuffs are used for anchoring the longitudinal elements wherein the compressive cuffs may be located at any desirable portion of the body and not simply the ankles, wrists and waist.

Figure 7:
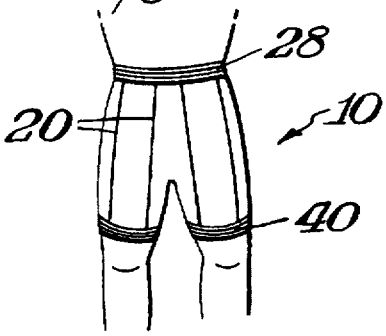
FIGS. 7–9 are front elevational views showing still yet other forms of this invention.

FIG. 7 illustrates a modified form of garment 10 which is in the pair of a pair of shorts that would be used without any shirt. In this form compressive cuffs 40 above the knees and cuff 28 at the waist would be used for anchoring the elements 20.

Figure 8:
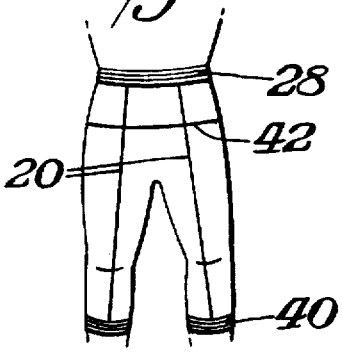

FIG. 8 illustrates a variation of the garment shown in FIG. 7 wherein the leg portions of the shorts extends below the knees. FIG. 8 also illustrates the mounting of an elastic element 42 in a transverse direction. Such orientation for the elastic element is also shown in FIG. 2. In both of these embodiments both longitudinal and transverse resistive elements are used in combination with the compressive members. Such combination of longitudinal and transverse resistive elements may be used with compressive bands and/or garments themselves made entirely of compressive material or having sections, such as portions of or all of the sleeves, legs, etc. made of compressive material.

Figure 9:
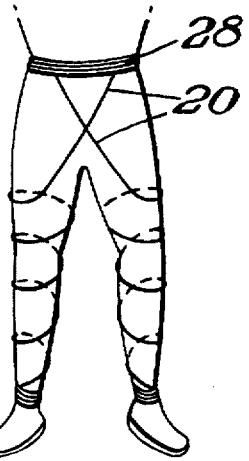

FIG. 9 shows a variation of the invention wherein the elongated elements are arranged in a spiral type direction down the legs. This could be done by providing guide members, such as tunnels, loops, etc. to direct where the cords will be located or by sewing the cords into the garment at the preferred locations. Although FIGS. 7–9 illustrate a garment which includes only a pants section the invention may also be practiced where the garment is only a shirt section or where the pants section and shirt section are used together as separate members or are combined into a one-piece suit. Thus such spiral direction could be on the arms or body.

It is to be understood that the invention may be practiced where the resistive elements are totally separate and distinct from the portion of the garment having compression. Thus, for example, a harness or vest or other structure incorporating the resistive elements may be worn preferably over the portion of the garment having compression. Similarly, portions of the garment having compression may be disposed or sandwiched between portions or layers of the garment having elongated resistive elements and vice versa.

It is to be understood that while various features are shown with respect to different embodiments, such features may be incorporated in other embodiments within the spirit of this invention.

What is claimed is:

1. An energy expenditure garment including a body portion and a pair of limb portions, a plurality of endless compressive elastic resilient bands at spaced locations of said garment for encircling spaced portions of a wearer and providing a compressive force against the wearer at the spaced portions, said endless compressive elastic resilient bands having a greater compressive force than any tensile force applied by said endless compressive elastic resilient bands, a plurality of spaced elongated elements at spaced locations of said garment, each of said elongated elements being made of elastic resilient material, said elongated elements being located across areas of said garment which would be subjected to back and forth movement during performance of an activity by the wearer, anchoring structure at spaced locations of each of said elongated elements for creating a resistance tensile force across said areas of movement of said garment in opposition to the movement of the wearer, said elongated elements having a tensile force at said areas of movement of said garment which is greater than any compressive force provided by said elongated elements, and said endless compressive elastic bands having a greater compressive force than adjacent portions of said garment.

2. The garment of claim 1 wherein each of said limb portions includes a cuff of closed loop circumferential form to completely surround the end of the limb of the user, said cuff being made of elastic resilient material which comprises means for applying a compressive force to the end of the limb, said cuffs being said compressive bands and at least one of said elongated elements being anchored to said cuff whereby said cuffs are said anchoring structure.

3. The garment of claim 2 wherein said elongated element is detachably anchored to said cuff.

4. The garment of claim 2 wherein said elongated element is mounted to said cuff in a permanent non-detachable manner.

5. The garment of claim 1 wherein said entire body and limb portions are made of elastic resilient material.

6. The garment of claim 1 wherein said elongated elements are anchored to said bands.

7. The garment of claim 1 wherein said elongated elements pass along side said bands without connection thereto.

8. The garment of claim 1 wherein said elongated elements include longitudinally oriented and transversely oriented elements.

9. The garment of claim 1 wherein said garment includes a pants portion, said limb portions being leg sections of said pants portion, and said plurality of elongated elements being located on said pants portion and anchored across areas of said pants portion which would be subjected to back and forth movement during the performance of an activity by the wearer.

10. The garment of claim 9 wherein said pants portion includes ankle cuffs, said ankle cuffs being of closed loop circumferential form to completely surround the ankle of the user, said ankle cuffs comprising said compressive bands, and at least some of said elongated elements being anchored to said ankle cuffs whereby said ankle cuffs comprise said anchoring structure.

11. The garment of claim 10 wherein said garment further includes a shirt portion having arm sections terminating in wrist cuffs, each of said wrist cuffs being one of said sections of closed loop circumferential form, compressive band further comprising said wrist cuffs.

12. The garment of claim 11 wherein said pants portion and said shirt portion are connected together to form a one piece garment.

13. The garment of claim 9 wherein said leg sections terminate above the knees.

14. The garment of claim 9 wherein said leg sections terminate just below the knees.

15. The garment of claim 9 wherein said pants includes a waist portion, and suspenders being secured to said waist portion.

16. The garment of claim 15 wherein said suspenders are integral with said pants.

17. The garment of claim 1 wherein said elongated elements are arranged in a spiral orientation.

18. The garment of claim 1 wherein said garment includes a shirt portion, said limb portions being arm sections of said shirt portion, and said plurality of elongated elements being located on said shirt portion and anchored across areas of said shirt portion which would be subjected to back and forth movement during the performance of an activity by the wearer.

19. The garment of claim 18 wherein said shirt portion includes wrist cuffs, said wrist cuffs being of closed loop circumferential form to completely surround the wrist of the user whereby said wrist cuffs comprise said compressive bands, and at least some of said elongated elements being anchored to said wrist cuffs whereby said wrist cuffs further comprise said anchoring structure.

20. The garment of claim 1 wherein said garment includes a shirt portion having arms terminating in wrists and includes a pants portion terminating in ankles and includes a waist portion located where said shirt portion and said pants portion meet.

21. The garment of claim 20 wherein said compressive bands include wrist cuffs and ankle cuffs and a waist band.

22. The garment of claim 21 wherein said wrist cuffs and said ankle cuffs and said waist band comprise said anchoring structure.

23. The garment of claim 20 wherein said anchoring structure comprises foot stirrups and hand loops.

24. An energy expenditure garment in the form of a pants having a body portion and a pair of legs, said pants being made of compressive elastic resilient material having a greater compressive force than any tensile force applied by said material, each of said legs terminating in a compressive cuff, said body portion terminating in a compressive waist band, said body portion having a front side and a back side, suspenders connected to said waist band and extending from said front side to said back side, a plurality of spaced elongated elements extending down said body portion and said legs, each of said elongated elements being made of elastic resilient material, said elongated elements being located across areas of said pants which would be subjected to back and forth movement during performance of any activity by the wearer, said elongated elements being anchored to said cuffs and to said waist band for creating a resistance tensile force across said areas of movement in opposition to the movement of the wearer, and said elongated elements having a tensile force at said areas of movement which is greater than any compressive force provided by said elongated elements.

25. The garment of claim 24 including further of said elongated elements extending from said waist band at said front side and extending over said suspenders to said back side.

26. The garment of claim 25 wherein said further elongated elements are anchored to said waist band.

27. A method of expending energy comprising providing a garment having a body portion and limb portions and having at least one section thereof made of closed loop circumferential form and made of an elastic resilient material, providing a plurality of elongated elements made of elastic resilient material on the garment, anchoring the elements at locations across from areas of the garment which would be subjected to back and forth movement during the performance of an activity by the wearer, placing the garment on the wearer, applying a compressive force in a closed loop circumferential form at the section of the garment made of elastic resilient material, applying a resistance force which opposes movement of the user by the elongated elements to create linear resistance forces during the performance of an activity by the wearer, continuing the performance to continuously applying the compressive force and repeatedly applying the resistance forces, and altering the amount of resistance force during the course of an exercise program by changing the garment.

* * * * *